US005673817A

United States Patent [19]

Mullen et al.

[11] Patent Number: 5,673,817

[45] Date of Patent: Oct. 7, 1997

[54] ALL-PURPOSE DISPENSER FOR LIQUIDS SUCH AS MILK, CREAM AND JUICES, AND BULK PRODUCTS SUCH AS CONDIMENTS AND SALAD DRESSINGS

[75] Inventors: James T. Mullen; Joseph F. Mullen, Jr., both of Exton, Pa.

[73] Assignee: Rapid Cartridge Dispensing Systems, Inc., Lionville, Pa.

[21] Appl. No.: 416,644

[22] Filed: Apr. 5, 1995

[51] Int. Cl.[6] ..... B65D 35/22

[52] U.S. Cl. ..... 222/94; 222/105; 222/143; 222/183; 222/185.1

[58] Field of Search ..... 222/94, 96, 105, 222/129, 143, 183, 185.1

[56] References Cited

U.S. PATENT DOCUMENTS

| | | | |
|---|---|---|---|
| 2,622,772 | 12/1952 | Tamminga | 222/522 |
| 3,191,810 | 6/1965 | Johnston | 222/185.1 X |
| 4,304,341 | 12/1981 | Shirley | 222/131 |
| 4,574,986 | 3/1986 | Boris et al. | 222/94 |
| 4,757,920 | 7/1988 | Harootain, Jr. et al. | 222/146.6 |
| 4,866,945 | 9/1989 | Bender et al. | 62/3.61 |
| 4,913,713 | 4/1990 | Bender et al. | 62/3.61 |
| 4,921,135 | 5/1990 | Pleet | 222/105 |
| 4,921,139 | 5/1990 | Fischer et al. | 222/129.1 |
| 4,932,561 | 6/1990 | Boxall | 222/54 |
| 5,186,359 | 2/1993 | Brown et al. | 222/94 X |
| 5,462,168 | 10/1995 | Oberhelman et al. | 222/105 X |
| 5,462,201 | 10/1995 | Wilkins | 222/105 X |

*Primary Examiner*—Joseph Kaufman

*Attorney, Agent, or Firm*—John F. A. Earley; John F. A. Earley, III

[57] ABSTRACT

An all-purpose dispensing unit for dispensing liquid products such as milk, cream, juices, iced tea, water, liquid eggs, fruit drinks, lemonade, wine, and other liquids, and for dispensing bulk products such as salad dressings and condiments including ketchup and mustard, comprises a cabinet having a chamber adapted to receive one or more cartridges with each cartridge containing a different selected liquid to be dispensed. Each cartridge comprises a container for holding the liquid, a front door panel on the cartridge adapted to close the front wall opening of the cabinet chamber to prevent the escape of cold air from the chamber and act as a door to the cabinet chamber, and a dispensing valve extending outwardly from the front door panel and connected to the liquid in the container.

8 Claims, 4 Drawing Sheets

ALL-PURPOSE DISPENSER FOR LIQUIDS SUCH AS MILK, CREAM AND JUICES, AND BULK PRODUCTS SUCH AS CONDIMENTS AND SALAD DRESSINGS

BACKGROUND OF THE INVENTION

1. Field of the Invention

This invention relates to dispensing apparatus for dispensing liquids and bulk materials, and more particularly concerns an all-purpose dispenser for dispensing liquids. The term "liquids" as used herein includes such products as milk, cream, juices, iced tea, water, liquid eggs, fruit drinks, lemonade, wine, and other liquids, and also includes bulk products such as salad dressings and condiments including ketchup and mustard.

2. Description of the Prior Art

Previous food service dispensers encountered problems because of limited counter space as in a diner, and with limited dispensing versatility and flexibility. Also, maintaining the food service dispensers was a problem.

For example, if there is a milk dispenser, a juice dispenser, an iced tea dispenser, a coffee dispenser, a hot chocolate dispenser, a cold drink dispenser, and a cream dispenser on a counter, too much counter space is used by all these food dispensers. Moreover, each dispenser may not be used for much of the day. For example, a juice dispenser may be very active at breakfast, but inactive during lunch and dinner, and yet it takes up counter space. And a salad dressing dispenser may be very active at lunch and diner, but inactive during breakfast.

SUMMARY OF THE INVENTION

The all-purpose dispenser of this invention offers a solution to the problems of the prior art by combining simplicity, flexibility, and versatility into a compact, efficient, all-purpose, liquid and bulk dispenser.

For example, the all-purpose dispenser of this invention maximizes the use of counter space, which is expensive and premium space, by providing for quick substitution of one liquid for another in the dispenser, thus making good use of counter space during the course of a serving day. This is essential in order to generate sales and profits.

Single purpose dispensing systems, like for orange juice, are inefficient because they are mainly used for breakfast and are not used for many hours of the day.

The present invention is capable of dispensing many different products during the course of the day so that premium counter space is not taken up by an inactive dispenser.

The dispenser of the present invention is designed to use minimum space side-to-side while taking advantage of its height and depth. For example, a three selection dispenser of the present invention may have a nine gallon capacity in sixteen inches of counter space, side-to-side.

As to dispensing versatility, the all-purpose dispenser of this invention is designed to dispense a variety of products. It has the capacity to dispense cream, half and half, and lowfat milk during breakfast and coffee breaks, and by simply swapping cartridges, during lunch it may dispense juices, iced tea, and lemonade, and during dinner it may dispense fruit drinks, milk, iced tea, and so on.

As to dispensing flexibility, the all-purpose dispenser of this invention may be of two types: reusable cartridges, or disposable cartridges. The reusable cartridge may be of stainless steel and requires cleaning and sanitizing. This reusable system reduces packaging costs, but the cost of maintaining this system may offset the savings in packaging.

Disposable cartridges are filled and delivered by the company which produces the packaged product. They meet health requirements and may be made of synthetic plastic, paper, or bag-in-the box packaging materials. These may be totally disposable containers, including the dispensing valve. A new bag or plastic container and a new valve is used with each disposable cartridge, thus maintaining a sanitary system.

The all-purpose dispenser of this invention is simple to operate: simply slide the old cartridge out of the cabinet, and slide the new cartridge into the cabinet. That's all there is to it.

DETAILED DESCRIPTION OF THE DRAWINGS

Turning now to the drawings, there is shown an all-purpose dispensing unit 11 which comprises a cabinet 13 having a chamber 15 formed by a top wall 13*a* and a bottom wall 13*b* connected by two side walls 13*c*, 13*d*, a rear wall 13*e* connected between the top wall 13*a*, bottom wall 13*b* and side walls 13*c*, 13*d*, and a front wall 13*f* which has one or more front wall openings 17*a*, 17*b*, 17*c*. Each front wall opening 17*a*, 17*b*, 17*c* is adapted to receive a cartridge 18, 19, 20 which contains a liquid to be dispensed.

Figure 1:
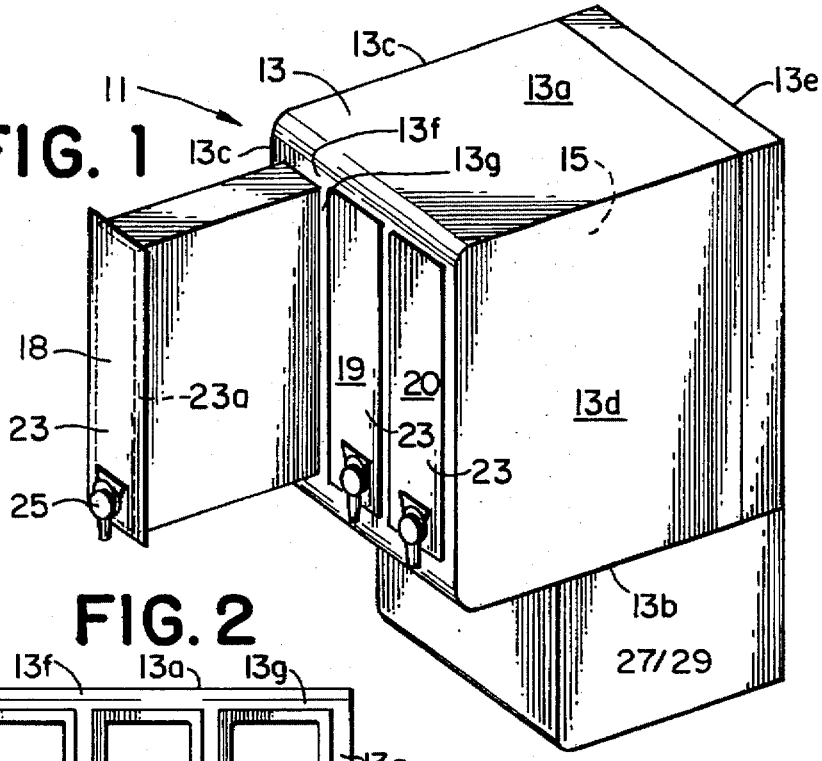
FIG. 1 is a view in perspective of an all-purpose dispensing unit constructed in accordance with this invention.
Figure 2:
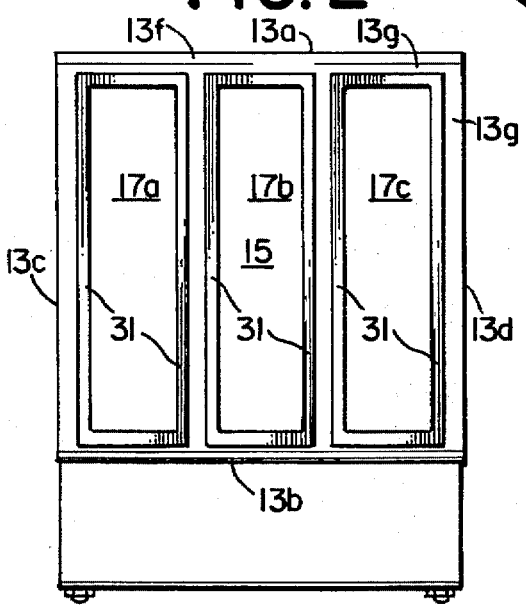
FIG. 2 is a view in front elevation of a compartment which forms an element of the all-purpose dispensing unit.
Figure 3:
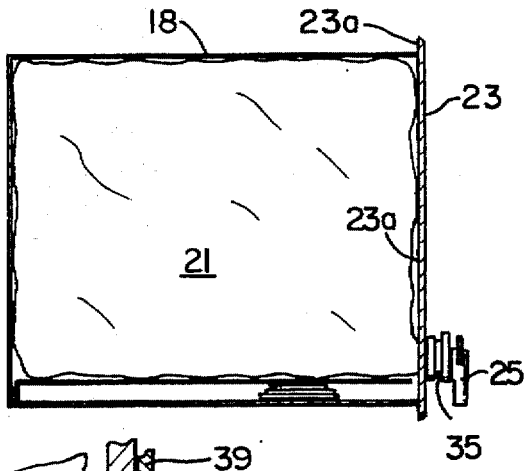
FIG. 3 is a view in side elevation of one of the cartridges of FIG. 1 with the near sidewall removed to show the inside of the cartridge.
Figure 4:
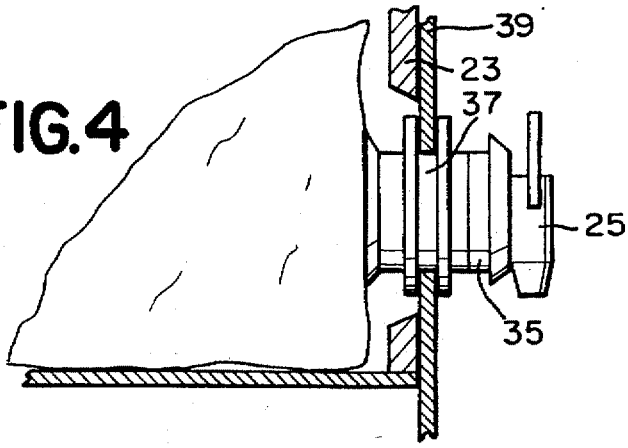
FIG. 4 is a partial view on a larger scale, partly in side elevation and partly in cross section, and shows a dispensing valve and fitment mounted in the door panel of the cartridge.

Each cartridge 18, 19, 20 comprises a container 21 which in the embodiment of FIG. 3 is a plastic bag. Each cartridge 18, 19, 20 has a front door panel 23 which is adapted to close a front wall opening 17*a*, 17*b*, 17*c* of the cabinet chamber 15.

The cabinet front wall 13*f* has a front wall surface 13*g*, and each cartridge 18, 19, 20 has a front door panel 23 with a rear surface 23*a*.

The front door panel 23 of the cartridges 18, 19, 20 is adapted to close the front wall opening 17*a*, 17*b*, 17*c* of the cabinet chamber 15.

A dispensing valve 25 extends outwardly from the front door panel 23 and is connected to the liquid in the bag 21.

The bag 21 is a disposable, one time use bag which insures that the bag 21 is safe to use and is sanitary.

A refrigeration unit 27 is connected to the cabinet 13 for cooling the cabinet chamber 15 and its contents, and a heating unit 29 is connected to the cabinet 13 for heating the cabinet chamber 15 and its contents.

A magnetic gasket 31 is mounted on the front surface 13*g* of the cabinet front wall 13*f* along the perimeter of front wall openings 17*a*, 17*b*, 17*c*, and when the front door panel 23 is closed the gasket 31 is between the rear surface 23*a* of the front door panel 23 and the front surface 13*g* of the front wall 13*f*.

The bag 21 holds a liquid and is connected to dispensing valve 25 by a fitment 35 extending through a hole 37 in door panel 23. The hole 37 has a door slide member 39 which is slid to open position to open the hole 37 to pass the dispensing valve 25 through the door panel 23. The door slide member 39 is slid to closed position to close and hold the dispensing valve 25 in the door panel 23.

The door slide member 39 clamps over the fitment 35 which extends between the bag 21 and the dispensing valve 25.

Figure 5:
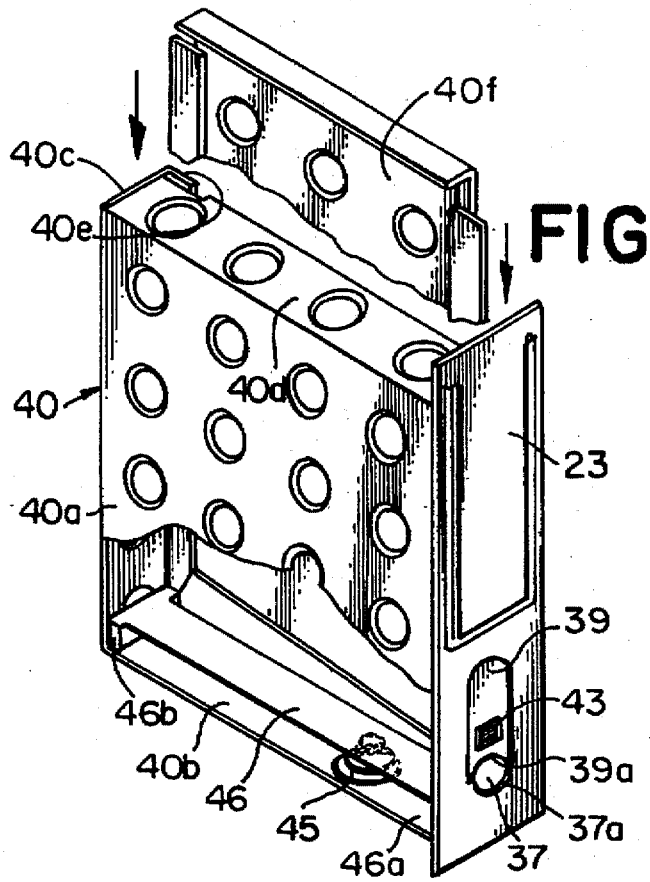
FIG. 5 is a view in perspective of the cartridge frame.

FIG. 5 shows a cartridge frame 40 in perspective and in more detail. Cartridge frame 40 includes front door panel 23, hole 37 having a bottom edge 37*a* which is a half circle, and door slide member 39 which has a bottom edge 39*a* that is half-circular. A raised surface 43 is formed on door slide member 39 to make it easier to slide the door slide member 39 up to admit or remove the dispensing valve 25 and fitment 35, and to slide door slide member 39 down to clamp onto the fitment 35 and hold the dispenser valve 25 in place.

Cartridge frame 40 is provided with a fixed side wall 40*a*, a bottom wall 40*b*, a rear wall 40*c*, a top wall 40*d*, and another side wall 40*e* which has a sliding side door 40*f* for opening and closing cartridge frame 40 for admitting or removing the bag 21.

Also, mounted on the bottom wall 40*b* is a spring 45 which supports one end of a floating bottom panel 46 that has a free end 46*a* and a pivot support end 46*b*. The bottom of the bag 21 is supported by floating bottom panel 46 and spring 45. Therefore the bottom of the liquid and the bag remain above the dispensing hole 37 in door panel 23 to insure that all the liquid is dispensed from the bag 21 and does not remain in the bottom of the bag.

Turning to FIGS. 6*a*–6*d*, there is shown the operation of the sliding door member 39 as the bag 21 is being loaded into the cartridge 40.

Figure 6A:
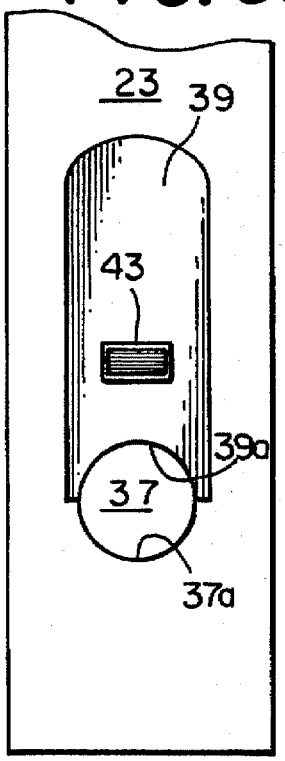
FIGS. 6*a*, 6*b*, 6*c*, and 6*d* are partial views on a larger scale and in front elevation of a portion of the front panel of the cartridge and shows the steps of a container bag being loaded into the cartridge.

In FIG. 6*a*, the door slide member 39 is shown in closed position around the empty hole 37 in door panel 23.

Figure 6B:
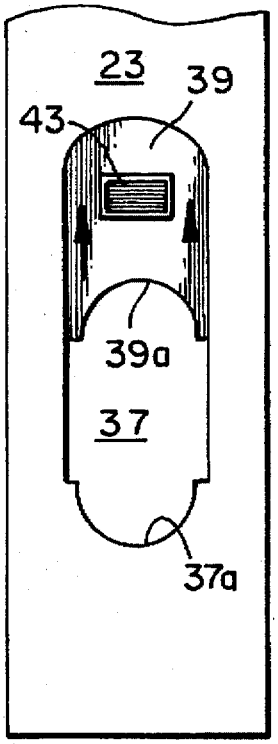

FIG. 6*b* shows the door slide member 39 in upper position, which extends the size of the opening of the hole 37.

Figure 6C:
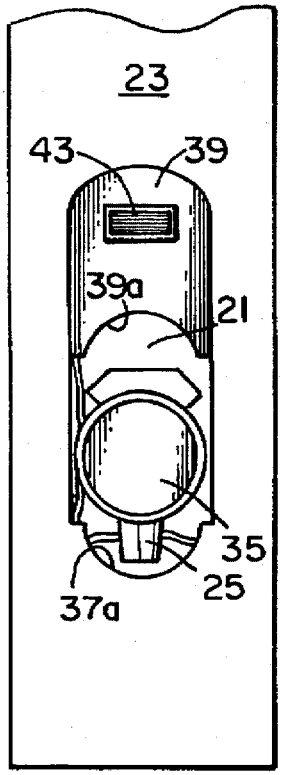
Figure 6D:
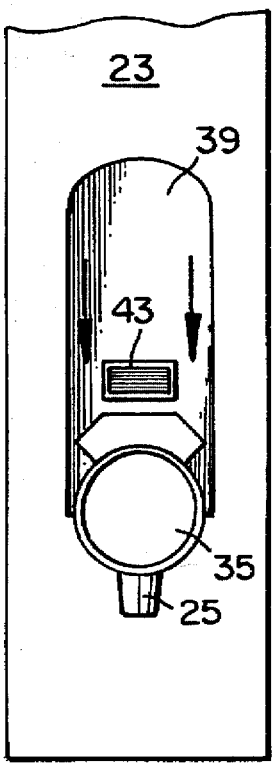

FIG. 6*c* shows the dispensing valve 25 and fitment 35 being inserted into the extended open hole 37, and FIG. 6*d* shows the door slide member 39 closed about the fitment 35 to hold the dispensing valve 25 in place.

Figure 7:
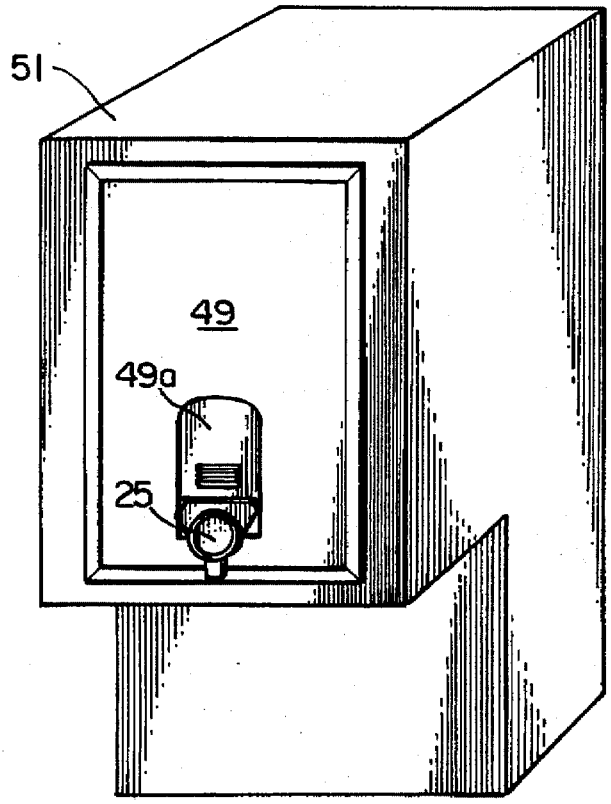
FIG. 7 is a view in perspective of an alternative embodiment of the invention and shows a compartment with a single cartridge.

FIG. 7 shows another embodiment of the invention which has but one cartridge 49 mounted in a cabinet 51. The cartridge 49 is somewhat wider than the cartridges 18, 19, 20 in order to increase the stability of the cabinet 51.

Figure 8:
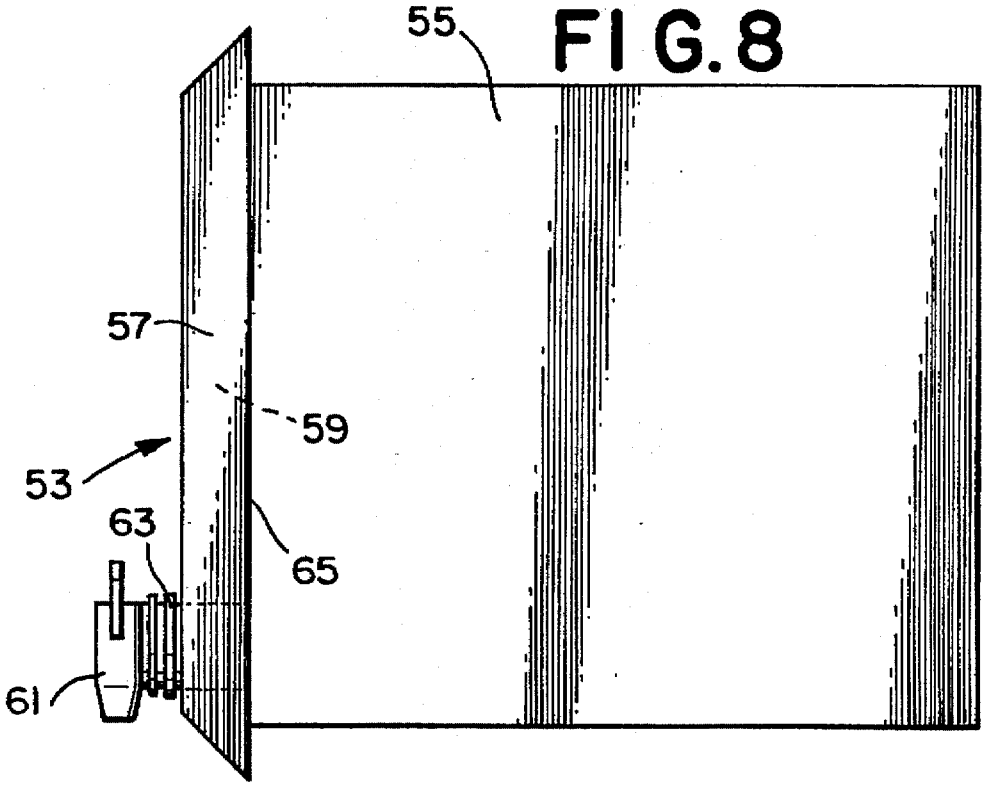
FIG. 8 is a view in side elevation of an alternative embodiment of a cartridge wherein the container of the cartridge is a rigid plastic container instead of a flexible bag.

FIG. 8 shows a third embodiment of a cartridge 53 which is preferably made of plastic and has a rigid container 55 connected to a front door panel 57 which is provided with a heat insulating air pocket 59.

A dispensing valve 61 is connected to the container 55 by a fitment 63. A metal gasket 65 mounted on the rear surface of front door panel 57 holds the front door panel 57 against the magnetic gasket 31 formed around the perimeter of the front wall opening 17*a*, 17*b*, 17*c* of a cabinet 13.

The cartridge 53 is completely disposable, and is used once and discarded, dispenser 61 and all.

Figure 9:
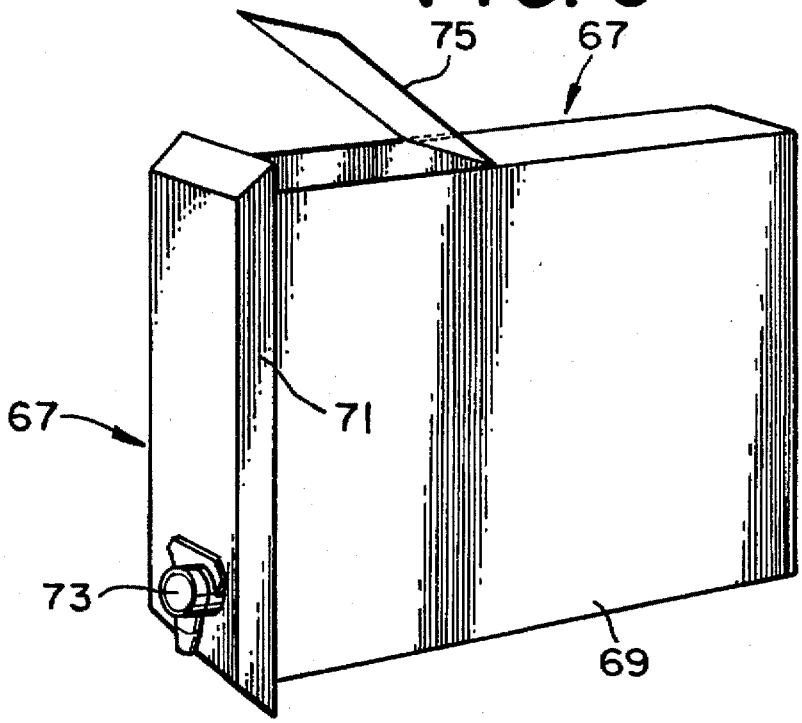
FIG. 9 is a view in perspective of another embodiment of a cartridge which is a reusable cartridge and has a hinged refill panel.

Turning now to the fourth embodiment of the invention as shown in FIG. 9, there is illustrated a reusable cartridge 67 which may be constructed of stainless steel, plastic, or other materials, and which includes a rigid container 69, a front door panel 71 which is composed of thick heat insulation material, and a dispensing valve 73 mounted on front door panel 71 and connected to the liquid in container 69. A refill panel door member 75 is hingedly connected to the top wall of the container 69 and is adapted to be opened for refilling the container 69 when it has been emptied of its liquid.

The cartridge 67 is reusable, but must be thoroughly cleaned and sanitized after each time its liquid has been dispensed, before the cartridge 67 is refilled.

In operation, the liquid is dispensed from the dispensing valve of all of the cartridges until the liquid has been totally dispensed, or until it is desired to replace one cartridge by another which dispenses a different liquid. In the cartridge 18, 19, 20 of the first embodiment of the invention, the spring 45 and pivoted bottom panel 46 elevates the bottom of the bag 21 to insure that the bottom of the bag 21 is above the dispensing valve 25 so that all of the liquid is dispensed, and none of it remains in the bag 21 below the level of the dispensing valve 25.

Also, in the first embodiment of the invention, the sidewall 40*f* is slid open, the bag 21 is inserted into the cartridge frame 40 shown in FIG. 5, the door slide member 39 is slid upwardly to extend the opening at the hole 37, the dispensing valve 25 and fitment 35 are inserted through the expanded hole 37, the hole 37 is closed by sliding the door slide member 39 downwardly about the fitment 35, the sidewall 40*f* is slid closed and the cartridge 18, 19, 20 is ready to be inserted into a chamber 15 of a cabinet 13 through a front wall opening 17*a*, 17*b*, 17*c*. When all of the liquid has been dispensed from the container bag 21, the cartridge 18, 19, 20 is removed from the cabinet 13, the empty bag 21 is removed from the cartridge 18, 19, 20 by opening the sidewall 40*f*, opening the hole 37 in the front door panel 23 by sliding the door slide member 39 upwardly, withdrawing the fitment 35 and dispensing valve 25 through the expanded hole 37, and discarding the used bag 21 together with its fitment 35 and dispensing valve 25. Then another bag container 21 is inserted into the frame 40 of the cartridge 18, 19, 20 and the refilled cartridge is ready to go.

The operation of the single cartridge 49 of FIG. 7 is the same as the operation of the cartridges 18, 19, 20. Cartridge 49 is provided with a sliding door 49*a* for holding the bag fitment.

The operation of the third embodiment shown in FIG. 8 is simpler than the operation of the first and second embodiments of the invention since the container 55 of FIG. 8 is filled by the supplier, and the cartridge 53 is merely inserted into the cabinet 13 by the user, and removed from the cabinet 13 when the cartridge 53 is empty or is being temporally replaced by another cartridge 53.

In the operation of the fourth embodiment shown in FIG. 9, reusable cartridge 67 is merely inserted into the chamber 15 of the cabinet 13, the liquid is dispensed until empty, the cartridge 67 is removed from the cabinet 13 and is thoroughly cleaned and sanitized, and is then refilled through the opening provided by the refill panel door member 75.

Then the refilled cartridge 67 is ready to be returned to service of dispensing liquids.

The words "dispensing valves" as used herein include faucets, spigots, and spouts.

It is to be noted that the cartridge itself provides its own door for the cabinet.

Also, a flexible bag with a dispensing valve may fit into the container of the cartridge with the dispensing valve extending from the bag through a hole in the door panel so as to be positioned outside the front door panel.

In the bag-in-box embodiment of the invention the bag and its dispensing valve may be completely disposable and require no cleaning.

All of the elements of the bag-in-a-box embodiment of the invention are recyclable.

The all-purpose dispensing unit of this invention has the advantage of being noiseless.

The all-purpose dispensing unit of this invention provides a nice delivery system for cold drinks, and also for hot drinks.

In the bag-in-box embodiment of this invention the containers are preferably made of synthetic plastic because cardboard boxes do not work well in wet areas but instead become wet, soft, and deteriorate or disintegrate.

A novel feature of the refrigerated embodiment of the all-purpose dispensing unit of this invention is the door panel which may contain an insulating air compartment, may be made of stainless steel of a type which is magnetic, and may contain finger spaces at the top and bottom to make it easier to move the cartridge into and out of the cabinet chamber.

The cartridge door panel acts as a door to the refrigerator cabinet.

An advantage of this invention is that the user of the refrigerated dispenser does not have to open a big refrigerator door that opens the whole refrigeration compartment and loses cold air. Each of the cartridges of the present invention has its own door so that in a three cartridge dispenser, only one door at a time is opened when replacing cartridges, so less cold air is lost.

The bags of the bag-in-box packages are designed for wines, vegetable oils, chemicals and other liquids or pastes.

The bags of the bag-in-box embodiment of this invention dispense even high viscosity products such as: syrup, salad dressings, catsup, and other products.

The all-purpose dispenser of this invention allows for quick change from breakfast syrup and coffee, to lunch and dinner salad dressings, dessert toppings, and coffee.

The all-purpose dispensing unit 11 of this invention comprises a cabinet 13 having a chamber 15 formed by a top wall 13*a* and a bottom wall 13*b* connected by two side walls 13*c*, 13*d*, a rear wall 13*e*, and a front wall 13*f* with one or more front wall openings 17*a*, 17*b*, 17*c*. A cartridge 18, 19, 20 is inserted into each front wall opening 17*a*, 17*b*, 17*c*, and each cartridge 18, 19, 20 contains a liquid to be dispensed. Each cartridge 18, 19, 20 has a frame 40, a bag 21 holding a liquid and having a dispensing valve 25 connected to the bag 21, and a fitment 35 connected between the dispensing valve 25 and the bag 21.

A sliding door 39 is positioned in the door panel 23 for allowing the dispensing valve 25 to pass through the door panel 23 to be mounted for dispensing the liquids outside the cartridge. The fitment 35 is supported in the door panel 23 by the sliding door 39.

A metal bushing is mounted on the rear surface 23*a* of the door panel 23 around the perimeter of the door panel 23, and a magnetic bushing or gasket 31 is mounted on the front surface 13*g* of the cabinet front wall 13*f* around the cabinet front wall openings 17*a*, 17*b*, 17*c*. The bushing on the rear surface of the door panel and the bushing 31 of the cabinet front wall openings 17*a*, 17*b*, 17*c* act to hold the door panel 23 closed by magnetism. A spring 45 in the bottom of the cartridge frame 40 raises the bottom of the bag 21 and the liquid in it to a level above the level of the dispensing valve 25 to allow all liquid to be dispensed rather than having some stay in the bottom of the bag 21.

In the embodiment of FIG. 9, there is shown a cartridge 67 which is reusable and may be inserted into each front wall opening 17*a*, 17*b*, 17*c*, and it has a rigid container 69 which may contain a liquid to be dispensed. A top refill panel 75 is hingedily attached to the top wall of the container 69, and the top refill panel 75 provides access for refilling the container. A front door panel 71 is mounted on the front wall of the container 69. The front door panel 71 is made of a thick heat-insulating plastic material and a dispensing valve 73 is mounted on the door panel 71 and connected to the liquid inside the container 69. The cartridge and the dispensing valve are cleanable and reusable.

We claim:

1. An all-purpose dispensing unit comprising a cabinet formed by a top wall and a bottom wall connected together by two side walls, a rear wall and a front wall with a front wall opening, a cartridge inserted into the cabinet by sliding it through the front wall opening, said cabinet front wall having a front wall surface, said cartridge including a container holding a liquid to be dispensed, a front door panel on the cartridge, said front door panel of the cartridge contacting the front wall of the cabinet and closing the front wall opening of the cabinet, said front door panel being fixed in position on the cartridge, said container being attached to said front door panel, said front door panel having a rear surface, said front door panel having edge portions which overlap edge portions of the front wall surface of the cabinet around the front wall opening, a dispensing valve extending outwardly from the front door panel and connected to the liquid in the container, and sealing means between the rear surface of the door and the front wall surface of the cabinet for holding the door closed and preventing cold and heat from escaping from the cabinet.

2. The all-purpose dispensing unit of claim 1, wherein said container is a bag which holds the liquid and is connected to the dispensing valve by a fitment which extends through a hole in the front door panel, said hole having an upper edge in a bottom portion of the front door panel, said hole in the front door panel having a door slide member in the front door panel with a bottom edge which is slid up to open the hole to pass the dispensing valve through the door panel, and is slid down to hold the dispensing valve in the door panel between the bottom edge of the door slide member and the upper edge of the bottom portion of the front door panel.

3. The all-purpose dispensing unit of claim 1, said container having rigid side, bottom, top and front walls connected together, said cartridge being disposable.

4. The all-purpose dispensing unit of claim 1, including a fitment mounted on the front door panel, and a heat insulating air pocket formed in the door panel.

5. An all-purpose dispensing unit comprising a cabinet having a chamber formed by a top wall and a bottom wall connected together by two side walls, a rear wall and a front wall with a front wall opening, a cartridge inserted into the front wall opening, said cabinet front wall having a front wall surface, said cartridge including a container holding a liquid to be dispensed, a front door panel on the cartridge closing the front wall opening of the cabinet, said front door panel having a rear surface, and a dispensing valve extending outwardly from the front door panel and connected to the liquid in the container, including a magnetic gasket mounted on the front surface of the cabinet front wall around each front wall opening and positioned, when the front door panel is closed, between the rear surface of the front door panel and the front surface of the front wall to close the front wall opening.

6. In an all-purpose dispensing unit comprising a cabinet formed by top and bottom walls connected by two side walls, a rear wall and a front wall with a front wall opening a cartridge comprising a container holding liquid to be dispensed, a front door panel on the cartridge, said front door panel of the cartridge being adapted to contact the front wall of the cabinet and close the front wall opening of the cabinet when the cartridge is inserted into the front wall opening of the cabinet, edge portions on the front wall opening of the cabinet, said front door panel being larger than said front wall opening and having edge portions which overlap edge portions of the front wall opening of the cabinet, and a dispensing valve extending outwardly from the front door panel and connected to the liquid in the container.

7. An all-purpose dispensing unit comprising a cabinet having a chamber formed by a top wall and a bottom wall connected by two side walls, a rear wall and a front wall with a front wall opening, a cartridge inserted into the front wall opening, each cartridge containing a liquid to be dispensed, each cartridge having a frame, a bag holding a liquid and having a dispensing valve connected to the bag, a fitment connected between the dispensing valve and the bag, a sliding door in the door panel for allowing the dispensing valve to pass through the door panel to be mounted for dispensing liquids outside the cartridge, said fitment being supported in the door panel by said sliding door, a metal bushing mounted on the rear surface of the door panel around the perimeter of the door panel, a magnetic bushing mounted on the cabinet front wall surface around the cabinet front wall opening, the bushing of the door panel and the bushing of the cabinet front wall opening acting to hold the door panel closed by magnetism, and a spring in the bottom of the cartridge frame for raising the bottom of the bag and the liquid in it to a level above the level of the dispensing valve to allow all liquid to be dispensed rather than having some stay in the bottom of the bag.

8. An all-purpose dispensing unit comprising a cabinet having a chamber formed by a top wall and a bottom wall connected by two side walls, a rear wall and a front wall with a front wall opening, a cartridge in the front wall opening, each cartridge having a container which contains a liquid to be dispensed, a top refill panel, a hinge attaching the top refill panel to the top wall of the container, said top refill panel providing access for refilling the container, a front door panel mounted on the front wall of the container, said front door panel being made of a thick heat-insulating plastic material, and a dispensing valve mounted on the door panel and connected to the liquid inside the container, said cartridge and said dispensing valve being cleanable and reusable.

* * * * *